US010456786B2

(12) United States Patent
Luoma, II

(10) Patent No.: US 10,456,786 B2
(45) Date of Patent: Oct. 29, 2019

(54) SEPTUMS AND RELATED METHODS

(71) Applicant: Robert P. Luoma, II, Colleyville, TX (US)

(72) Inventor: Robert P. Luoma, II, Colleyville, TX (US)

(73) Assignee: ABBOTT LABORATORIES, Abbott Park, IL (US)

( * ) Notice: Subject to any disclaimer, the term of this patent is extended or adjusted under 35 U.S.C. 154(b) by 626 days.

(21) Appl. No.: 13/796,553

(22) Filed: Mar. 12, 2013

(65) Prior Publication Data

US 2014/0260089 A1 Sep. 18, 2014

(51) Int. Cl.

| | |
|---|---|
| ***B01L 3/00*** | (2006.01) |
| ***A61J 1/14*** | (2006.01) |
| ***B65D 51/00*** | (2006.01) |

(52) U.S. Cl.

CPC ..... *B01L 3/523* (2013.01); *A61J 1/1406* (2013.01); *B65D 51/002* (2013.01); *B01L 2300/044* (2013.01)

(58) Field of Classification Search

CPC .... B01L 13/523; A61J 1/1406; B65D 51/002; B65D 2501/0027

USPC ..... 215/308

See application file for complete search history.

(56) References Cited

U.S. PATENT DOCUMENTS

| | | | | |
|---|---|---|---|---|
| 3,831,814 | A | 8/1974 | Butler | |
| 3,892,549 | A | 7/1975 | Lyshkow | |
| 4,254,884 | A | 3/1981 | Maruyama | |
| 4,287,995 | A | 9/1981 | Moriya | |
| 4,319,996 | A | 3/1982 | Vincent et al. | |
| 4,421,705 | A | 12/1983 | Hatakeyama et al. | |
| 4,459,256 | A | 7/1984 | Ziegler | |
| 4,472,276 | A * | 9/1984 | Taylor | B01D 33/0006 210/236 |
| 4,515,752 | A | 5/1985 | Miramanda | |
| 4,545,497 | A | 10/1985 | Martha, Jr. | |
| 4,652,429 | A | 3/1987 | Konrad | |
| 4,863,051 | A | 9/1989 | Eibner et al. | |
| 4,934,545 | A * | 6/1990 | Pezzoli | A61J 1/1406 215/250 |

(Continued)

FOREIGN PATENT DOCUMENTS

| | | |
|---|---|---|
| CH | 613621 | 10/1979 |
| CN | 101234681 | 8/2008 |

(Continued)

OTHER PUBLICATIONS

International Searching Authority, "International Search Report and Written Opinion of the International Searching Authority," issued in connection with application No. PCT/US2013/077956, dated Apr. 3, 2014, 11 pages.

(Continued)

*Primary Examiner* — Anthony D Stashick
*Assistant Examiner* — Raven Collins
(74) *Attorney, Agent, or Firm* — Hanley, Flight & Zimmerman, LLC

(57) ABSTRACT

Example apparatus including septums and related methods are disclosed. An example apparatus includes a septum that includes a first surface and a membrane coupled to at least a portion of the first surface. In addition, the example septum includes a second surface and ribs extending between the membrane and the second surface.

23 Claims, 7 Drawing Sheets

(56) References Cited

U.S. PATENT DOCUMENTS

| | | | | |
|---|---|---|---|---|
| 5,012,946 | A | 3/1991 | McCarthy | |
| 5,147,591 | A | 9/1992 | Yoshida | |
| 5,297,599 | A | 3/1994 | Bucheli | |
| 5,494,170 | A | 2/1996 | Burns | |
| 5,610,073 | A | 3/1997 | Chu et al. | |
| 5,637,099 | A | 6/1997 | Durdin et al. | |
| 5,678,684 | A | 10/1997 | Wright | |
| 5,699,923 | A | 12/1997 | Burns | |
| 5,702,019 | A | 12/1997 | Grimard | |
| 5,738,233 | A | 4/1998 | Burns | |
| 5,779,074 | A * | 7/1998 | Burns | B01L 3/50825 215/247 |
| 5,795,784 | A | 8/1998 | Arnquist et al. | |
| 5,819,964 | A * | 10/1998 | Grimard | B65D 51/002 215/249 |
| 5,856,194 | A | 1/1999 | Arnquist et al. | |
| 5,885,499 | A | 3/1999 | Aksberg | |
| 5,894,949 | A | 4/1999 | Taskis et al. | |
| 5,947,274 | A | 9/1999 | Taskis et al. | |
| 6,033,613 | A | 3/2000 | Heyn et al. | |
| 6,054,099 | A | 4/2000 | Levy | |
| 6,074,615 | A | 6/2000 | Lewis et al. | |
| 6,218,174 | B1 | 4/2001 | Keyser | |
| 6,361,744 | B1 | 3/2002 | Levy | |
| 6,391,241 | B1 | 3/2002 | Cote et al. | |
| 6,555,062 | B1 | 4/2003 | Lewis et al. | |
| 6,723,289 | B2 | 4/2004 | Iheme et al. | |
| 6,806,094 | B2 | 10/2004 | Anderson et al. | |
| 6,981,860 | B2 | 1/2006 | Takemoto et al. | |
| 7,329,307 | B2 | 2/2008 | Hrycak et al. | |
| 7,641,843 | B2 | 1/2010 | Taemmerich et al. | |
| 7,740,785 | B2 | 6/2010 | Taber et al. | |
| 8,034,272 | B2 | 10/2011 | Pavlovic et al. | |
| 8,303,914 | B2 * | 11/2012 | Zurcher | B01L 3/50825 422/547 |
| 8,387,810 | B2 | 3/2013 | Livingston et al. | |
| 8,387,811 | B2 | 3/2013 | Livingston et al. | |
| 8,418,872 | B2 * | 4/2013 | Smith | A61L 2/26 220/495.01 |
| 8,631,953 | B2 | 1/2014 | Pavlovic et al. | |
| 9,095,500 | B2 | 8/2015 | Brandenburger et al. | |
| 9,375,714 | B2 | 6/2016 | Fritchie et al. | |
| 2002/0113033 | A1 | 8/2002 | Claessens | |
| 2002/0127147 | A1 | 9/2002 | Kacian et al. | |
| 2002/0131902 | A1 | 9/2002 | Levy | |
| 2003/0199095 | A1 | 10/2003 | Yuyama et al. | |
| 2003/0223472 | A1 | 12/2003 | Ravalico et al. | |
| 2004/0052688 | A1 | 3/2004 | Adema et al. | |
| 2004/0131506 | A1 | 7/2004 | Zurcher | |
| 2004/0144474 | A1 | 7/2004 | Drummond et al. | |
| 2005/0059161 | A1 | 3/2005 | Anderson et al. | |
| 2005/0079633 | A1 | 4/2005 | Kacian et al. | |
| 2005/0171489 | A1 | 8/2005 | Weaver et al. | |
| 2005/0279387 | A1 | 12/2005 | Blackwell et al. | |
| 2006/0118167 | A1 | 6/2006 | Neas et al. | |
| 2006/0263248 | A1 | 11/2006 | Gomm et al. | |
| 2007/0020629 | A1 | 1/2007 | Ross et al. | |
| 2007/0034592 | A1 * | 2/2007 | Pavlovic | B01L 3/50825 215/253 |
| 2009/0273121 | A1 | 11/2009 | Pavlovic et al. | |
| 2009/0282932 | A1 | 11/2009 | Blackwell et al. | |
| 2010/0034700 | A1 | 2/2010 | Rousseau et al. | |
| 2010/0059474 | A1 | 3/2010 | Brandenburger et al. | |
| 2010/0107784 | A1 | 5/2010 | Stein | |
| 2011/0150704 | A1 | 6/2011 | Fritchie et al. | |
| 2012/0186697 | A1 | 7/2012 | Py et al. | |
| 2012/0226243 | A1 | 9/2012 | Weaver et al. | |
| 2013/0226145 | A1 | 8/2013 | Weaver et al. | |
| 2014/0008321 | A1 * | 1/2014 | Lentz | B65D 47/36 215/257 |

FOREIGN PATENT DOCUMENTS

| | | |
|---|---|---|
| DE | 8132447 | 3/1982 |
| DE | 9006079 | 9/1990 |
| DE | 4222560 | 1/1994 |
| EP | 0731355 | 9/1996 |
| EP | 0765653 | 4/1997 |
| EP | 0766087 | 4/1997 |
| EP | 1435254 | 7/2004 |
| EP | 1495811 | 1/2005 |
| EP | 1997558 | 12/2008 |
| GB | 612046 | 11/1948 |
| GB | 2083622 | 3/1982 |
| IT | 1068283 | 3/1985 |
| JP | S5647656 | 4/1981 |
| JP | S5910349 | 1/1984 |
| JP | S59230539 | 12/1984 |
| JP | S62-48707 | 3/1987 |
| JP | S63-156721 | 10/1988 |
| JP | S59-010349 | 11/1990 |
| JP | H03-090931 | 9/1991 |
| JP | H05-33058 | 4/1993 |
| JP | H07-51253 | 2/1995 |
| JP | H08-015254 | 1/1996 |
| JP | 10503739 | 4/1998 |
| JP | H10-147357 | 6/1998 |
| JP | 2000009734 | 1/2000 |
| JP | 2001314485 | 11/2001 |
| JP | 2003118766 | 4/2003 |
| JP | 2003325662 | 11/2003 |
| JP | 2004506182 | 2/2004 |
| JP | 2004513039 | 4/2004 |
| JP | 2004142780 | 5/2004 |
| JP | 2004157020 | 6/2004 |
| JP | 2005324832 | 11/2005 |
| JP | 2007292585 | 11/2007 |
| JP | 2009504521 | 2/2009 |
| JP | 2009196666 | 9/2009 |
| JP | 2010517607 | 5/2010 |
| JP | 2010524788 | 7/2010 |
| JP | 2010526561 | 8/2010 |
| JP | 2002544076 | 12/2012 |
| NL | 9002423 | 6/1992 |
| WO | 9116242 | 10/1991 |
| WO | 1996/04189 | 2/1996 |
| WO | 0069389 | 11/2000 |
| WO | 2001028701 | 4/2001 |
| WO | 02072265 | 9/2002 |
| WO | 2003062796 | 7/2003 |
| WO | 2004076034 | 9/2004 |
| WO | 20070022046 | 2/2007 |
| WO | 2008009821 | 1/2008 |
| WO | 2008130880 | 10/2008 |
| WO | 2012112486 | 8/2012 |

OTHER PUBLICATIONS

Notification of the First Office Action and Search Report, issued by the State Intellectual Property Office of the P.R. China, in connection with Chinese Patent Application No. 201380074557.3, dated May 19, 2016, 15 pages.

State Intellectual Property Office of China, "Second Office Action," issued in connection with Chinese Patent Application No. 201380074557.3, dated Jan. 11, 2017, 15 pages (includes English translation).

Japanese Patent Office, "Search Report," issued in connection with Japanese Patent Application No. 2016-500146 dated Oct. 4, 2016, 17 pages (includes English translation).

European Patent Office, "Examination Report," issued in connection with European Patent Application No. 13 821 408.5, dated Oct. 18, 2016 (4 pages).

Japanese Patent Office, "Office Action," issued in connection with Japanese Patent Application No. 2016-500146 dated Nov. 1, 2016, 7 pages (includes English translation).

Encyclopedia of Polymer Science and Engineering, 2nd Edition, vol. 8, John Wiley & Sons, Inc. (1987), pp. 102-137 (Copy not

(56) References Cited

OTHER PUBLICATIONS provided, cited in an Information Disclosure Statement filed in U.S. Appl. No. 11/200,976, filed Jan. 11, 2006).
United States Patent and Trademark Office, "Non-Final Office Action," issued in connection with U.S. Appl. No. 11/200,976, dated Oct. 2, 2008, 5 pages. (Copy not provided as this is a USPTO document. Applicant will provide document upon request from Examiner.).
United States Patent and Trademark Office, "Final Office Action," issued in connection with U.S. Appl. No. 11/200,976, dated Apr. 6, 2009, 5 pages. (Copy not provided as this is a USPTO document. Applicant will provide document upon request from Examiner.).
United States Patent and Trademark Office, "Non-Final Office Action," issued in connection with U.S. Appl. No. 11/200,976, dated Aug. 5, 2009, 6 pages. (Copy not provided as this is a USPTO document. Applicant will provide document upon request from Examiner.).
United States Patent and Trademark Office, "Final Office Action," issued in connection with U.S. Appl. No. 11/200,976, dated Mar. 4, 2010, 7 pages. (Copy not provided as this is a USPTO document. Applicant will provide document upon request from Examiner.).
"Hardness Measurement and Specifications," http://www.machinist-materials.com/hardness.htm, Feb. 2010 (Copy not provided, cited in the Notice of References Cited issued in connection with in U.S. Appl. No. 11/200,976 dated Mar. 4, 2010).
United States Patent and Trademark Office, "Notice of Allowance," issued in connection with U.S. Appl. No. 11/200,976, dated Sep. 13, 2013, 12 pages. (Copy not provided as this is a USPTO document. Applicant will provide document upon request from Examiner.).
United States Patent and Trademark Office, "Notice of Allowance," issued in connection with U.S. Appl. No. 12/500,338, dated Jun. 13, 2011, 5 pages. (Copy not provided as this is a USPTO document. Applicant will provide document upon request from Examiner.).
European Patent Office, "Communication Pursuant to Article 94(3) EPC," issued in connection with European Patent Application No. EP06813404.8, dated Feb. 2, 2010, 3 pages.
European Patent Office, "Summons to Attend Oral Proceedings Pursuant to Rule 115(1) EPC," issued in connection with European Patent Application No. EP06813404.8, on Mar. 8, 2010, 3 pages.
State Intellectual Property Office of China, "Notification to Grant Patent Right," issued in connection with Chinese Patent Application No. 201380074557.3, dated May 31, 2017, 4 pages (includes English translation).
Japanese Patent Office, "Second Office Action," issued in connection with Japanese Patent Application No. 2016-500146 dated Apr. 4, 2017, 6 pages (includes English translation).
World Intellectual Property Organization, "International Search Report," issued in connection with International Patent Application No. PCT/US2006/031570, dated Jan. 18, 2007, 3 pages.
World Intellectual Property Organization, "Written Opinion," issued in connection with International Patent Application No. PCT/US2006/031570, dated Feb. 10, 2008, 6 pages.
World Intellectual Property Organization, "International Preliminary Report on Patentability," issued in connection with International Patent Application No. PCT/US2006/031570, dated Feb. 12, 2008, 7 pages.
Japanese Patent Office, "Decision of Refusal," issued in connection with Japanese Patent Application No. JP2008526273, dated Nov. 7, 2012, 4 pages (include English translation).
Japanese Patent Office, "Notification of Reasons for Refusal," issued in connection with Japanese Patent Application No. JP2008526273, dated Nov. 14, 2011, 8 pages (include English translation).
Japanese Patent Office, "Search Report by Registered Searching Organization," issued in connection with Japanese Patent Application No. JP2008526273, dated Oct. 17, 2011, 14 pages (include English translation).
United States Patent and Trademark Office, "Advisory Action," issued in connection with U.S. Appl. No. 11/200,976, dated Jun. 16, 2009, 3 pages. (Copy not provided as this is a USPTO document. Applicant will provide document upon request from Examiner.).
United States Patent and Trademark Office, "Examiner's Answer to Appeal Brief," issued in connection with U.S. Appl. No. 11/200,976, dated Oct. 28, 2010, 9 pages. (Copy not provided as this is a USPTO document. Applicant will provide document upon request from Examiner.).
United States Patent and Trademark Office, "Decision on Appeal," issued in connection with U.S. Appl. No. 11/200,976, on May 28, 2013, 5 pages. (Copy not provided as this is a USPTO document. Applicant mill provide document upon request from Examiner.).
European Patent Office, "Communication under Rule 71(3) EPC," issued in connection with European Patent Application No. 13821408.5, dated Jan. 9, 2018, 28 pages.
European Patent Office, "Summons to attend oral proceedings pursuant to Rule 115(1) EPC," issued in connection with European Patent Application No. 13821408.5, on Jul. 31, 2017, 5 pages.
Japanese Patent Office, "Office Action," issued by the Japanese Patent Office in connection with Japanese Application No. 2017-211855, dated Sep. 4, 2018, 13 pages (includes English translation).
European Patent Office, "Extended European Search Report," issued by the European Patent Office in connection with European Application No. 18177196.5, dated Oct. 2, 2018, 8 pages.
Australian Intellectual Property Office, "Notice of Acceptance," issued in connection with application No. AU 2010340134, dated Aug. 2, 2013, 2 pages.
Andrews et al., "Photodeactivation of Ethyl Violet: A Potential Hazard of Sodasorb Anesthesiology," 72:59-64, 1990, 6 pages.
Engage 8407 Polyolefin Elastomer Dow Plastics. Datasheet [online]. 2008 [retrieved on Aug. 18, 2009]. Retrieved from the Internet: <URL:htpp://www.ides.com>, 1 page.
Engage 8411 Polyolefin Elastomer Dow Plastics. Datasheet [online]. 2009 [retrieved on Aug. 18, 2009]. Retrieved from the Internet: <URL:htpp://www.ides.com>, 2 pages.
International Searching Authority, "International Search Report," issued in connection with application No. PCT/US2010/059902, dated Apr. 6, 2011, 5 pages.
International Bureau, "International Preliminary Report on Patentability," issued in connection with application No. PCT/US2010/059902, dated Jun. 26, 2012, 7 pages.
Australian Intellectual Property Office, "Patent Examination Report No. 1," issued in connection with application No. AU 2010340134, dated Dec. 20, 2012, 3 pages.
United States Patent and Trademark Office, "Non-Final Rejection," issued in connection with U.S. Appl. No. 12/643,250, dated Sep. 19, 2011, 26 pages.
United States Patent and Trademark Office, "Final Rejection," issued in connection with U.S. Appl. No. 12/643,250, dated Apr. 12, 2012, 20 pages.
United States Patent and Trademark Office, "Non-Final Rejection," issued in connection with U.S. Appl. No. 12/643,250, dated Oct. 10, 2012, 15 pages.
United States Patent and Trademark Office, "Final Rejection," issued in connection with U.S. Appl. No. 12/643,250, dated Mar. 4, 2013, 16 pages.
National Intellectual Property Administration, P. R. China, English Translation of First Office Action, issued in connection with Chinese patent application No. 20170685023.4, dated Sep. 30, 2018, 10 pages.
International Searching Authority, "International Preliminary Report on Patentability", issued in connection with international application No. PCT/US2013/077956 dated Sep. 15, 2015, 7 pages.
National Intellectual Property Adminstration, P.R. China, "Second Office Action," issued in connection with application No. 201710685023.4, dated Jun. 17, 2019, 9 pages (English translation included).
Japanese Patent Office, "Notice of Rejection," issued in connection with application No. 2017-211855, dated Jun. 1, 2019, 12 pages (English translation included).

* cited by examiner

SEPTUMS AND RELATED METHODS

FIELD OF THE DISCLOSURE

This disclosure relates generally to storage containers and, more particularly, to septums and related methods.

BACKGROUND

Septums are used with storage containers, such as a sample container or a reagent container, to prevent or reduce evaporation of the contents of the container and to control access to the contents. Typically, probes are used to access the contents of the container by penetrating the septum and aspirating the contents from the container.

However, penetration of a septum by a probe may cause damage to the septum and the probe. For example, in a diagnostic instrument, a reagent bottle having a septum and a probe for accessing a reagent stored in the reagent bottle may become misaligned due to tolerance stack-up in the diagnostic instrument. The misaligned probe may engage the septum at a location other than a center of the septum. Off-center impact of the septum by the probe gouges the surface of the septum and increases the risk of coring the septum. Such damage to the septum compromises the ability of the septum to control evaporation and prevent contamination of the contents. Further, variability in penetration force upon impact of the probe with the septum may result in deformation or bending of the probe.

Figure 1:
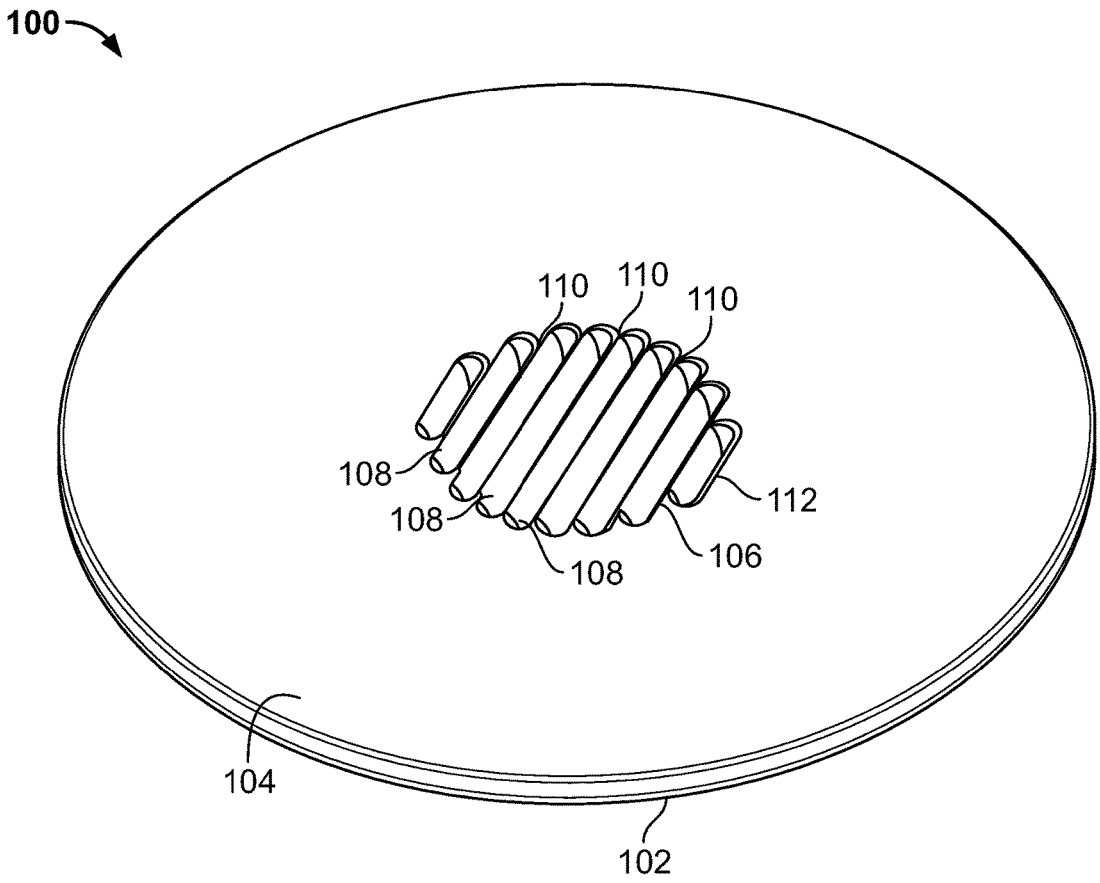
FIG. 1 is a perspective view of an example septum according to one or more aspects of the present disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is coupled to the other part with one or more intermediate part(s) located therebetween. Stating that any part is in contact with another part means that there is no intermediate part between the two parts.

DETAILED DESCRIPTION

Methods and apparatus including septums are disclosed. Septums are used with containers such as, for example, reagent bottles or sample containers that are used in diagnostic instruments such as, for example, clinical chemistry instruments, immunoassay instruments, hematology instruments, etc. Septums provide a seal to secure contents such as, for example, liquid contents, of the containers during shipment, use, and/or storage. In addition, septums minimize evaporation and contamination of the contents of the container. The contents of the container are accessed by, for example, a probe that penetrates the septum. An example probe for accessing the contents may be a pipette probe. However, penetration of a septum by a probe may cause damage to the septum and the probe when the probe and the septum are misaligned.

Disclosed herein are example septums and related methods that accommodate variability in the location of probe impact (e.g., due to alignment variations) and the probe impact force to prevent or minimize resultant damage to the septum and the probe. Additionally, the examples disclosed herein advantageously provide a seal to secure the contents of a container during transport of the container while preventing aggregation of, for example, reagent material microparticles that may accumulate on the surface of the septum that faces toward the container during movement of the container.

An example septum disclosed herein comprises a slotted structure that includes a plurality of ribs, strips, or elongated protrusions with a relatively thin membrane between the ribs. The example membrane serves as a seal that withstands forces that may be encountered by a container capped by the septum during shipping and storage of the container. The membrane is pierceable by, for example, a probe to access contents of the container. The slotted ribs deflect an end of the probe upon contact and direct the probe to penetrate the membrane between the ribs. Thus, the ribs provide a flexible structure that permits a consistent probe force to be used to pierce the membrane whether the probe is aligned with the septum or off-center. The consistent probe force reduces or eliminates the need for larger forces to drive the probe through the septum, particularly when there is misalignment between the probe and the septum. This reduced or minimized force reduces the likelihood of damage to the probe and the septum, for example, bending of the probe, coring of the septum, and/or plugging of the probe. Further, the slotted ribs minimize the size of an opening in the septum that results from piercing the septum with the probe. Whereas a septum constructed of only a thin membrane is prone to tearing, resulting in a large opening in the septum after multiple piercings by the probe, the slotted ribs in the example septum disclosed herein provide a degree of stiffness to the structure of the septum that resists tearing. The examples disclosed herein also reduce the possibility of contamination particles (e.g., produced by a gouged septum) from falling into the container and mixing with the contents of the container.

The example methods and apparatus disclosed herein may be implemented, for example, with container, such as a bottle, that stores samples or reagents. Additionally or alternatively, the example apparatus may be incorporated into or integrally formed with a lid of the container. The example methods and apparatus may further be implemented as part of a reagent kit for use with diagnostic instruments. When used as part of a reagent kit in operation with a diagnostic instrument, penetration of the septum by the probe may occur at a variety of septum contact points as determined by instrument assembly and operational tolerances.

An example septum disclosed herein includes a first surface, a second surface, and a membrane coupled to at least a portion of the first surface. The example septum also includes ribs extending between the membrane and the second surface.

In some examples, the membrane is integral with the first surface. Also, in some examples, the ribs are in parallel. In some examples, each rib includes a first end coupled to the membrane and a second curved end. In some examples, the second curved end has a parabolic cross-sectional shape.

Some of the disclosed examples include one of the ribs having a first length and a second one of the ribs having a second length. The second length, in this example, is different than the first length.

In some examples, the ribs form a symmetrical pattern. In some examples, the ribs form a circular pattern.

In some examples, the membrane forms a seal prior to penetration by a probe. In some examples, the membrane interconnects the ribs. In some examples, the membrane is frangible. Also, in some examples, the first surface is substantially flat.

Also disclosed herein are example septums in which each of the ribs has a depth about one and a half times a distance to an adjacent one of the ribs. Also, in some examples, each of the ribs has a depth about fifteen times a thickness of the membrane.

Also disclosed herein is an example apparatus that includes a vessel to contain at least one of a reagent or a sample. The example apparatus also includes a lid and a slotted septum formed in the lid.

In some examples, the slotted septum comprises a plurality of ribs coupled to a membrane. Also, in some examples, each rib of the plurality of ribs has a curved end. In addition, the example apparatus, in some examples, also includes a cap coupled to the lid, the cap having a neck surrounding the septum.

An example method is also disclosed that includes securing contents of a container with a septum comprising a plurality of ribs and a membrane seal and accessing the contents of the container by engaging a probe with one of the ribs. In addition, the method includes deflecting the probe between two of the ribs and piercing the membrane seal between the two of the ribs with the probe. In some examples, the deflecting of the probe includes the probe contacting a curved end of one of the ribs and moving between two of the ribs.

Figure 3:
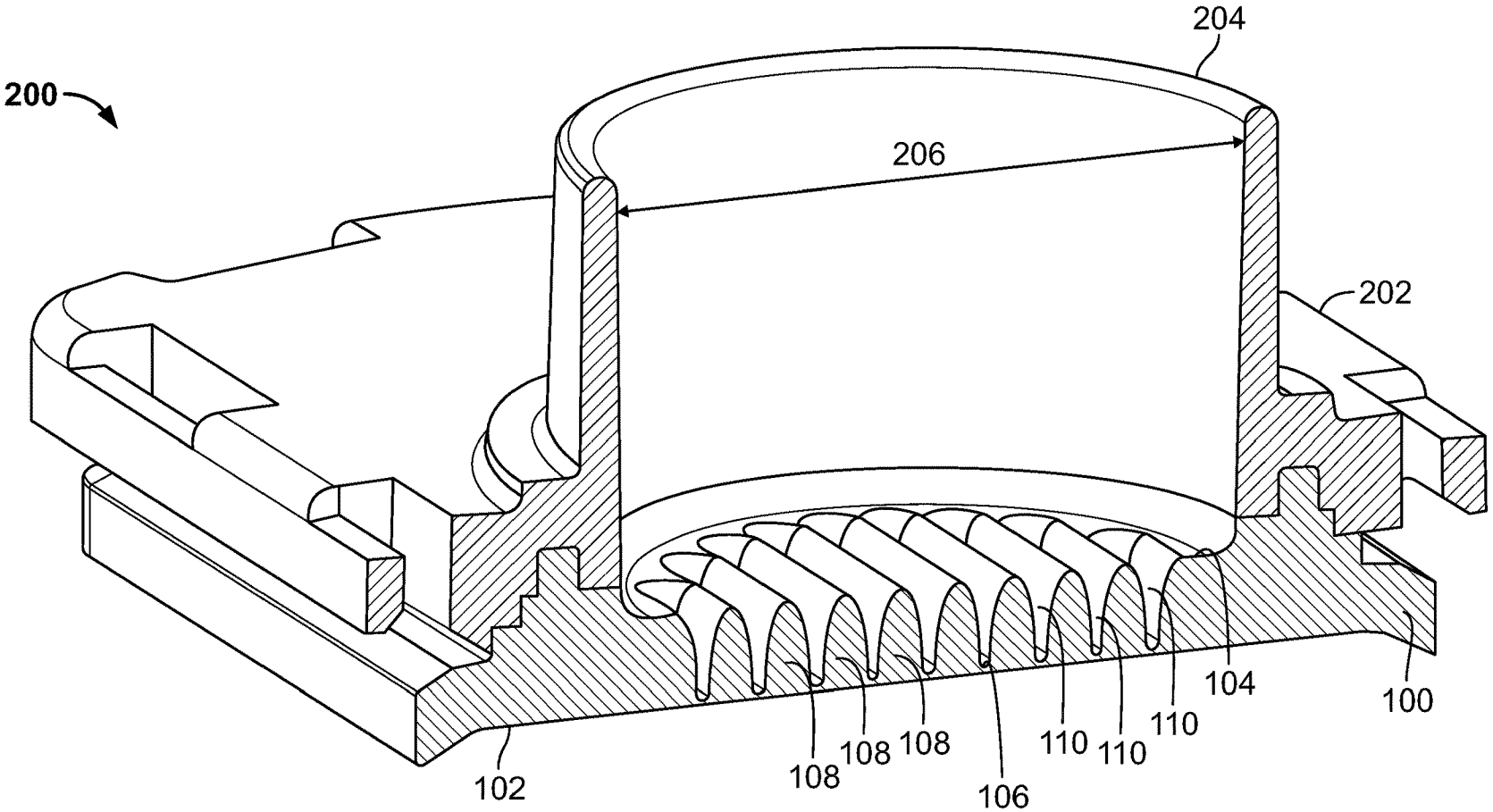
FIG. 3 is a cross-sectional view of the example septum and cap taken along the 3-3 line of FIG. 2.

Turning now to the figures, FIG. 1 depicts an example septum 100 having a first surface 102 and a second surface 104. The first surface 102 and the second surface 104 may comprise, for example, a thermoplastic material, including, but not limited to, a high density polyethylene. In this example, a membrane 106 is coupled to at least a portion of the first surface 102, as shown in FIG. 3. In some examples, the membrane 106 is disposed across or defined on the first surface 102. The example septum 100 further includes a plurality of ribs, strips, or elongated protrusions 108 that extends between the membrane 106 and the second surface 104. The ribs 108 and the membrane 106 may comprise an elastomeric material such as, for example, a thermoplastic polyolefin elastomer.

The plurality of ribs 108 and the membrane 106 may be formed using, for example, injection molding, compression molding, or casting processes. In some examples, the septum 100, including the first surface 102, the second surface 104, the membrane 106, and the plurality of ribs 108, are formed using a two-shot injection molding process.

In the illustrated example, the plurality of ribs 108 includes eight ribs 108 with nine valleys 110 formed between the ribs 108 and an edge 112 of the septum 100. In other examples, there may be any suitable number of ribs 108 and valleys 110 such as, for example, one, two, three, ten, eleven, etc. The ribs 108 are shown parallel to each other. In some examples, some or all of the ribs 108 are parallel relative to each other. In other examples, the ribs 108 may be arranged using other configurations including, for example, converging/diverging ribs, curved ribs, or other suitable arrangements. Also, in the illustrated example, a first rib has a different length than a second rib. In other examples, the ribs 108 may all have the same length. In addition, the ribs 108 may be arranged in various geometric orientations. For example, the ribs 108 may form a corrugated or louvered arrangement. Additionally or alternatively, the ribs 108 may be positioned in a symmetrical orientation, including, but not limited to, a circular pattern as shown in the illustrated example of FIG. 1. In other examples, the ribs 108 are not symmetrically oriented.

Figure 2:
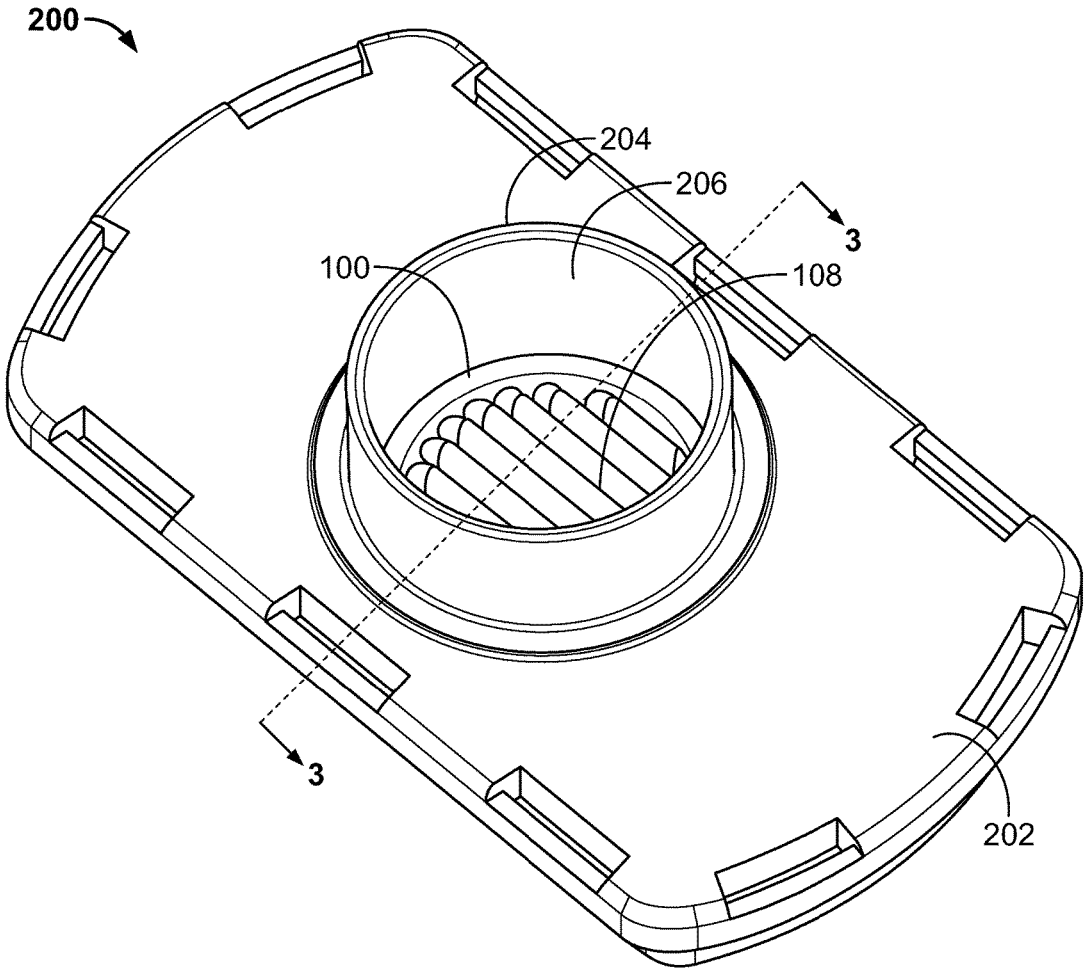
FIG. 2 is a perspective view of the example septum of FIG. 1 and an example cap according to one or more aspects of the present disclosure.
Figure 4:
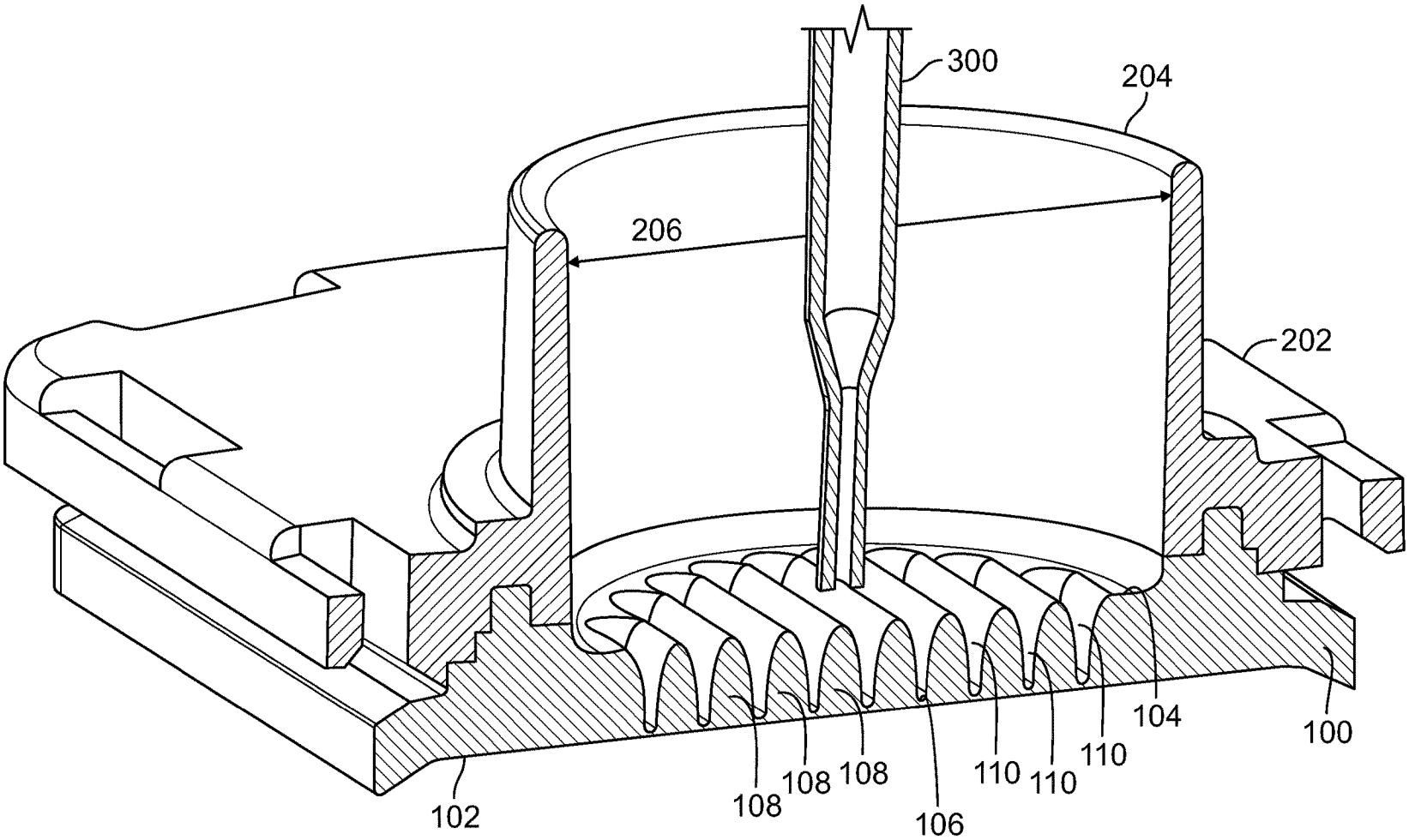
FIG. 4 shows the cross-sectional view of FIG. 3 with a cross-section of an example probe according to one or more aspects of the present disclosure.

FIG. 2 depicts an example apparatus 200 comprising the septum 100 in use with a cap 202. FIG. 3 shows a cross-section of the apparatus 200 taken along the 3-3 line of FIG. 2, and FIG. 4 shows the apparatus 200 engaged by an example probe 300. As shown in FIG. 2, the cap 202 has a neck 204 to provide access to the septum 100, including the plurality of ribs 108. As shown in FIG. 2, in the illustrated example the neck 204 defines an opening 206 that surrounds the ribs 108, and the ribs 108 face toward the opening 206 of the neck 204. In FIG. 2 the ribs 108 are shown in a circular pattern and the opening 206 is also shown has having a circular shape to permit access to the ribs 108. The orientation of the ribs 108 may be configured in accordance with the design of a cap 200 with an opening 206 having a shape other than circular. For example, the opening 206 may have a rectangular shape and the ribs 108 may be arranged in a rectangular configuration to align with the rectangular shape of the opening 206.

The opening 206 of the neck 204 defines a probe penetration location. Thus, the probe 300, for example, may be lowered to penetrate the septum 100 after the probe 300 is aligned within the opening 206. Due to tolerance stack-up variations arising from operational use of the septum 100 and the probe 300 with, for example, a diagnostic instrument, the probe 300 may not be aligned with a perfect center of the septum 100. For example, the septum 100 may have a circular shape with a center and the probe 300 may not be aligned with the center. Additionally or alternatively, the probe 300 may be positioned closer to the neck 204. However, in such an example, the misaligned probe 300 continues to impact one of the ribs 108 as the probe 300 passes through the opening 206. Upon impact with one of the ribs 108, the probe 300 is deflected to engage and penetrate the membrane 106. Deflection of the probe 300 with any of the ribs 108 allows for a consistent probe force to be used for impact of the probe 300 with the membrane 106 because a higher force is not needed to pierce through a thicker portion of the septum that was not designed to receive the probe. Thus, the probe 300 need not be aligned with the center of the septum 100 to penetrate the membrane 106 with minimal deflection, as any of the ribs 108 tolerate probe impact and enable consistent probe force with respect to penetration of the membrane 106.

FIGS. 3 and 4 show details of the structure of the septum 100 and the ribs 108. The illustrated example shows that the first ends of the ribs 108 are coupled to the membrane 106. The membrane 106 adjoins the first ends of the ribs 108. The second ends of the ribs 108 are rounded or curved. In the illustrated example, each rib 108 has the same cross-sectional shape. In other examples, the ribs 108 may have different shapes. As shown in the examples of FIGS. 3 and 4, the second ends of the ribs 108 have a parabolic cross-sectional shape. In other examples, the second ends may have another curved shape, a conical shape, and/or any other suitable shape.

FIG. 4 shows the probe 300 engaging the septum 100. As the probe 300 is lowered through the opening 206 of the cap 202, the probe 300 engages the septum 100. Such engagement of the probe 300 with the septum 100 may include, for example, the probe 300 making contact with one or more of the ribs 108, including, for example, a rounded or curved end of one of the ribs 108. Upon engagement of the probe 300 with, for example, the rounded or curved end of a rib 108, the rib 108 directs (e.g., deflects) the probe 300 to enter one of the valleys 110 defined by the ribs 108. For example, the probe 300 may enter a valley 110 formed between the rib 108 impacted by the probe and an adjacent rib 108. As the probe 300 enters the valley 110, the probe 300 engages and pierces the membrane 106. In other examples, the probe 300 is aligned with a valley 110 and pierces the membrane without deflecting off of a rib 108.

Whereas in FIG. 4 the probe 300 is illustrated as engaging the septum 100 at a rib 108 positioned in the center of the septum 100, in some examples the probe 300 may be off-center or misaligned with the center of the septum 100. When the probe is off-center, the probe 300 may impact any of the rib 108 to penetrate the membrane 106 in the same manner as if the probe 300 engaged with the center rib 108. Upon engagement with any of the ribs 108, the ribs 108 direct the probe 300 to enter an adjacent valley 110 and pierce the membrane 106. Thus, the probe 300 need not be aligned with the center of the septum 100 or pass through the center of the opening 206. Rather, the probe 300 may make contact with any of the ribs 108 as the probe 300 passes through the opening 206 to penetrate the septum 100.

In the illustrated example, each of the ribs is separated by a distance. The distance between the center of a base of two adjacent ribs 108 defines the width of a valley 110 formed between two of the ribs 108. For example, the width of a valley 110 may be one millimeter. A total distance across the plurality of ribs 108 may be, for example, about ten times the width of a valley 110. In some examples, the total distance across the ribs 108 of the septum 100 is ten millimeters. The ribs 108 also have a depth. In some examples, the depth or height of the ribs 108 may be equal to about one and a half times the width of the valley 110. For example, the depth of the ribs 108 may be 1.5 millimeters. Further, the membrane 106 has a thickness such that the membrane 106 is frangible and may be pierced by the probe 300. For example, the thickness of the membrane 106 may be 0.1 millimeters. In some examples, the ribs 108 may have a depth or height equal to about fifteen times the thickness of the membrane 106. It is to be understood that in manufacturing the septum 100, the width of the valleys 110 and/or the depth of the ribs 108 may be increased or decreased.

Figure 5:
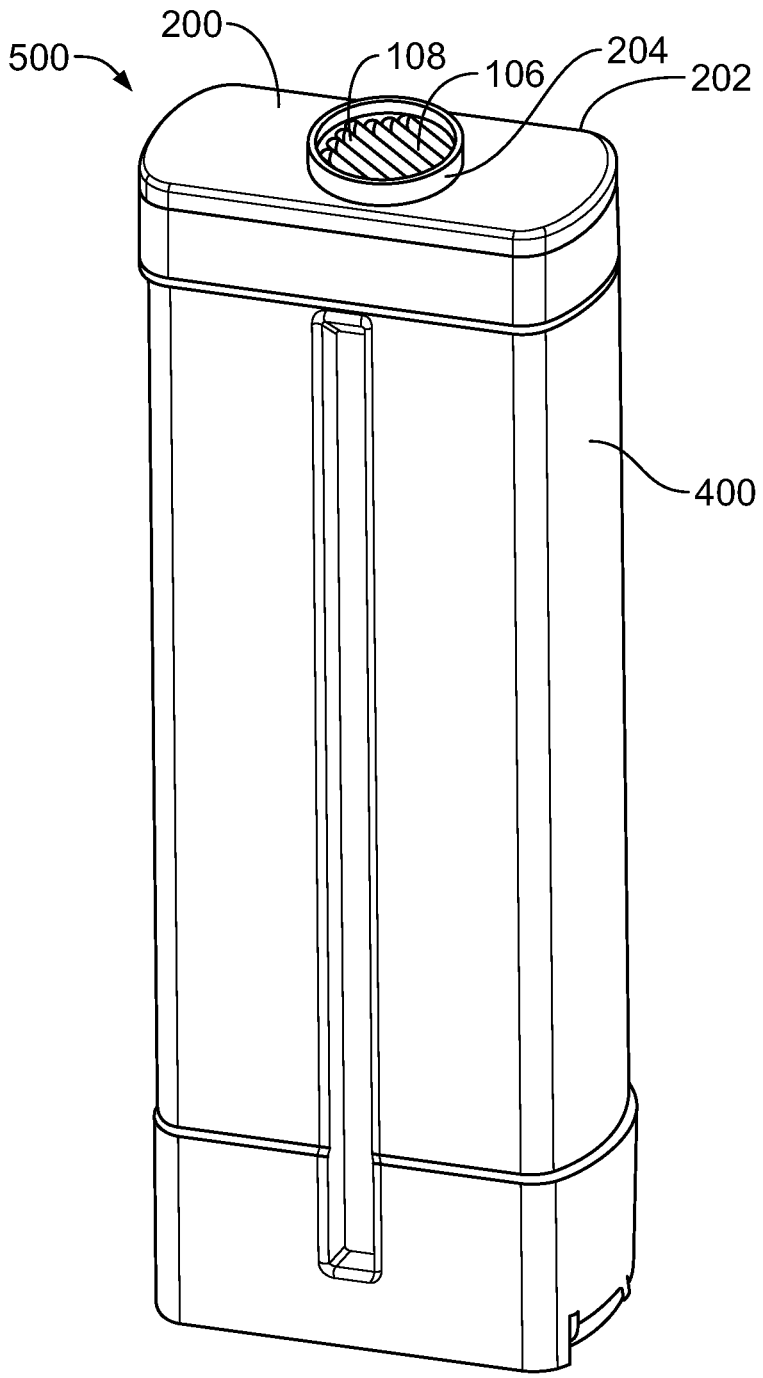
FIG. 5 is a perspective view of the example septum of FIG. 1 and an example container according to one or more aspects of the present disclosure.
Figure 6:
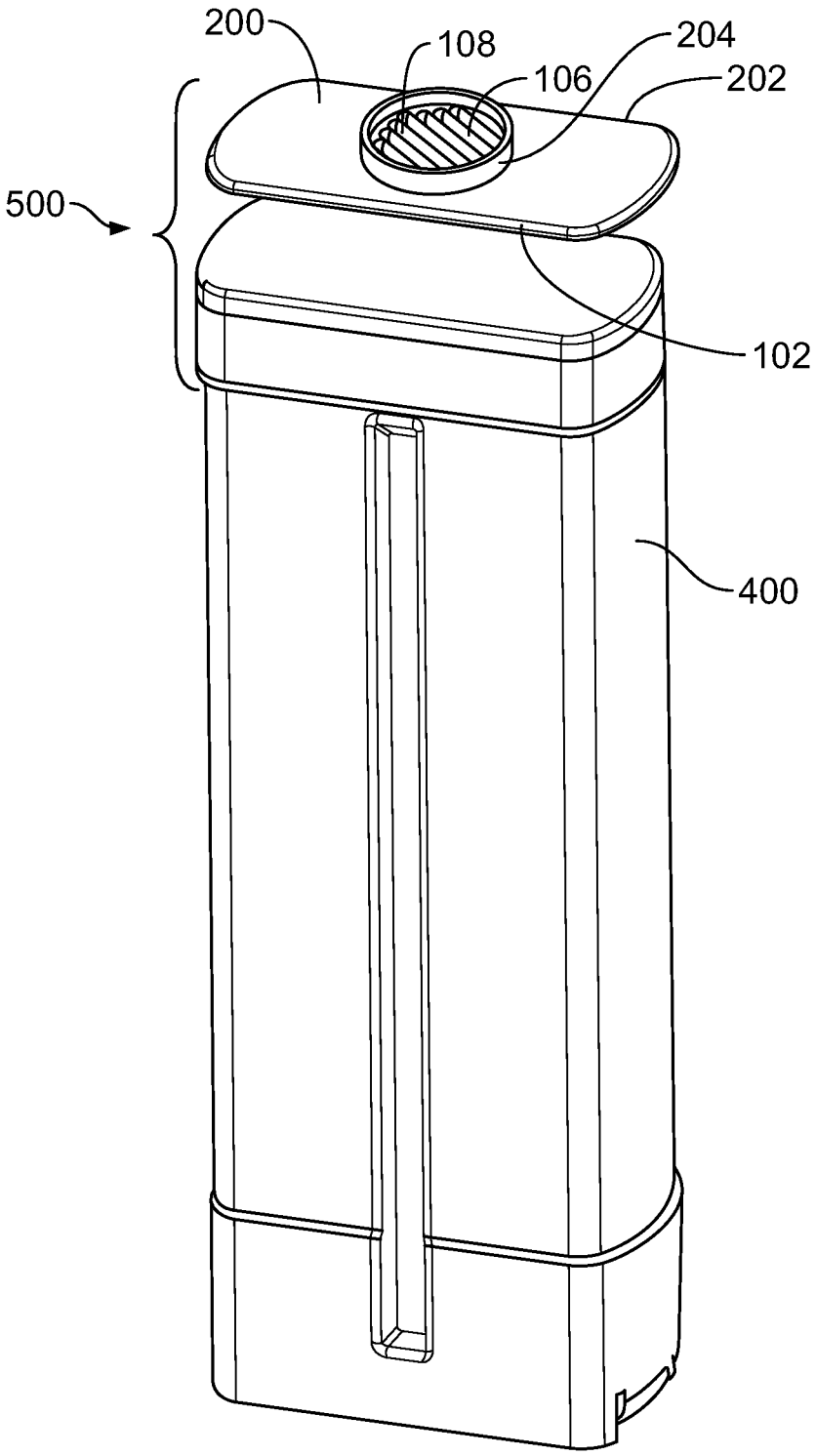
FIG. 6 is an exploded view of the example septum and container of FIG. 5.

FIG. 5 and FIG. 6 depict an example apparatus 500 comprising the septum 100 in operation with a container 400. The container 400 may be, for example, a vessel or a bottle. In FIGS. 5 and 6, the container 400 has a rounded rectangular shape, but the container 400 may be any other shape. The container 400 may hold contents, including, but not limited to, a sample or a reagent. As depicted in FIGS. 5 and 6, the container 400 includes the cap 200. The membrane 106 seals the contents held in the container 400. As shown in FIG. 6, in the illustrated example the first surface 102 of the septum 100 may face toward the inside of the container 400. In some examples, the first surface 102 of the septum 100 may be substantially flat to reduce the accumulation of microparticles from the contents of the container 400 on the first surface 102 as the container 400 is moved, for example, during shipping of the container 400.

Figure 7:
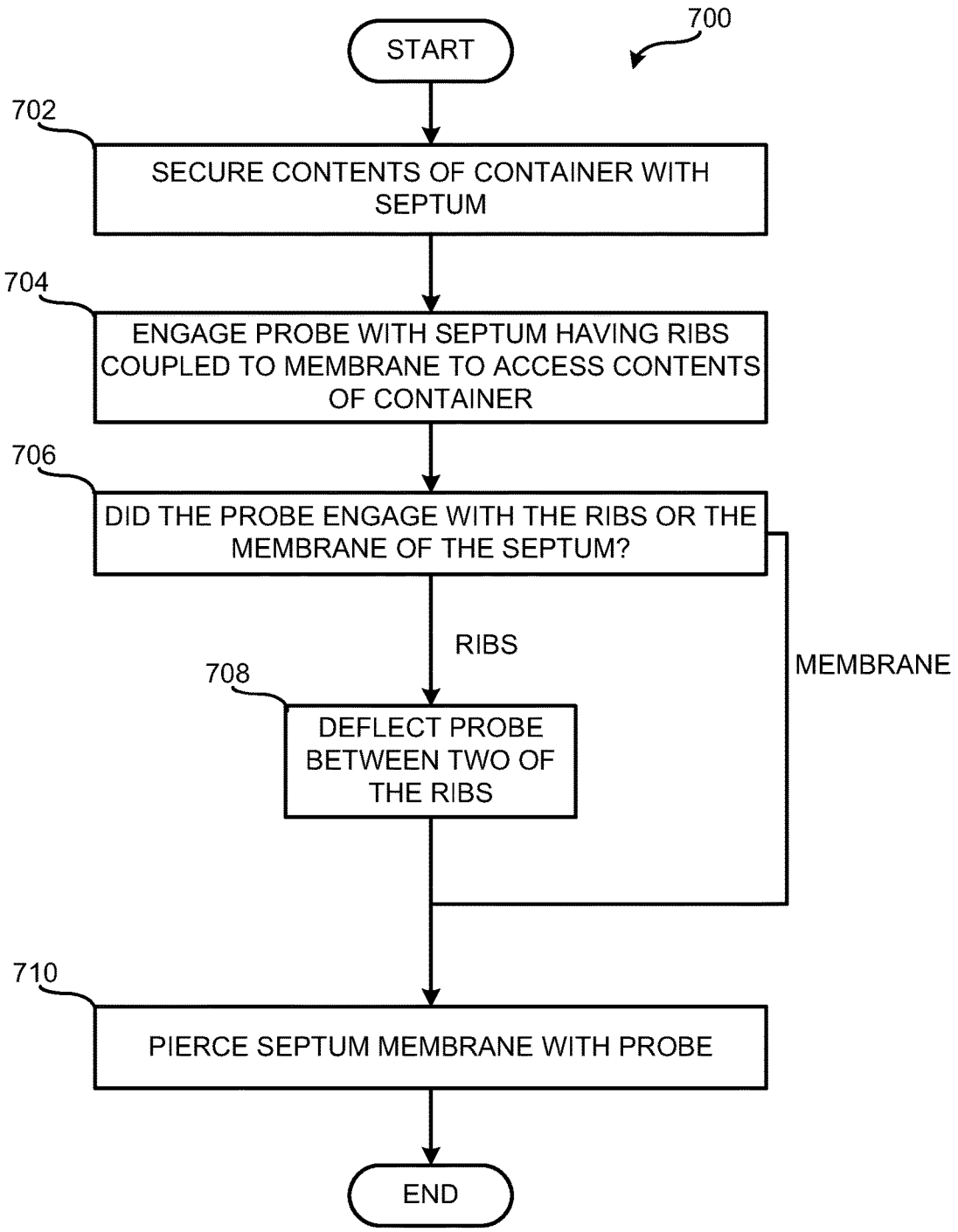
FIG. 7 is a flow diagram of an example method that can be used to implement the examples described herein.

FIG. 7 depicts an example flow diagram representative of a method 700 that may be implemented to access contents of a container 400 using a septum 100 with a probe 300 without damaging the septum 100 or the probe 300 when the probe 300 is either aligned with the center of the septum 100 or off-center. The example method 700 may be initiated by securing the contents of the container 400 with the septum 100 (block 702). For example, the membrane 106 of the septum 100 may seal the contents of the container 400. To access the contents of the container 400, the probe 300 may engage the septum 100 having a plurality of ribs 108 (block 704). The probe 300 may engage the ribs 108 or the directly with the membrane 106 (block 706). If the probe 300 has engaged any of the ribs 108 of the septum, for example, the rounded or curved end of one of the ribs 108, the probe 300 may be deflected between two of the ribs 108 (block 708). Upon deflection of the probe 300, the probe 300 may pierce the membrane 106 interconnecting two adjacent ribs 108 to access the contents of the container 400 (block 710). If the probe 300 has engaged the membrane 106, for example, if the probe 300 is aligned to engage the septum 100 between any two of the ribs 108, the probe 300 pierces the membrane (block 710) without being deflected by the ribs 108.

Further, although the example septum 100 is described with reference to the flowchart illustrated in FIG. 7, many other methods of implementing the example septum 100 may alternatively be used. For example, the order of execution of the blocks of FIG. 7 may be combined and/or some of the blocks described may be changed, eliminated, or additional blocks may be added. The method shown in FIG. 7 is only one example method describing the implementation of the septum 100.

From the foregoing, it will be appreciated that the above disclosed methods and apparatus provide for access of contents stored in a container with a probe using a slotted or grooved septum that prevents damage to the probe and the septum upon impact when the probe is either aligned with the septum or off-center. The examples disclosed above provide for maximum tolerance of off-center penetration of the septum by the probe through a plurality of ribs formed on the septum. The plurality of ribs is configured to provide for flexibility when the probe engages with the septum at multiple contact points and/or angles, including when the probe may be misaligned with the center of the septum. Upon contact of the probe with a rounded or curved end of one of the ribs, the rib directs (e.g., deflects) the probe to penetrate a frangible membrane located between two adjacent ribs. The probe may contact any of the ribs and the probe does not need to be aligned with the center of the septum for the ribs to deflect the probe to penetrate the membrane with a consistent probe force. As a result, the flexible ribs protect the integrity of the contents stored in the container by preventing damage to the septum and the probe, including instances of coring of the septum or plugging of the probe that may result in contamination of the contents of the container. The methods and apparatus disclosed may further serve to seal the contents stored in the container during transport of the container using the membrane that interconnects the plurality of ribs. The membrane comprises a frangible material that may be pierced by a probe to access to the contents secured in the container.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A septum comprising:

a first surface;

a membrane coupled to at least a portion of the first surface;

a second surface opposite the first surface; and ribs extending between the membrane and the second surface, the first surface spaced apart from the second surface by the ribs, each rib having a first end coupled to the membrane and a second end extending between a first edge of the second surface and a second edge of the second surface, a height of each rib defined between the membrane and the second surface, the ribs and the membrane to form a seal prior to penetration by a probe, wherein the second end is curved and has a parabolic cross-sectional shape having a vertex, and wherein the vertex is in a plane, and the first edge of the second surface and the second edge of the second surface are in the plane.

2. The septum of claim 1, wherein the membrane is integral with the first surface.

3. A septum comprising a first surface;

a membrane coupled to at least a portion of the first surface;

a second surface opposite the first surface; and ribs extending between the membrane and the second surface, the first surface spaced apart from the second surface by the ribs, each rib having a first end coupled to the membrane and a second end extending between a first edge of the second surface and a second edge of the second surface, a height of each rib defined between the membrane and the second surface, the ribs and the membrane to form a seal prior to penetration by a probe, wherein a first one of the ribs has a first length extending between the first edge of the second surface and the second edge of the second surface and a second one of the ribs has a second length extending between the first edge of the second surface and the second edge of the second surface, the second length being different than the first length.

4. The septum of claim 3, wherein the ribs are in parallel.

5. The septum of claim 3, wherein the second end is curved.

6. The septum of claim 3, wherein the ribs form a symmetrical pattern.

7. The septum of claim 3, wherein the ribs form a circular pattern.

8. The septum of claim 1, wherein the membrane interconnects the ribs.

9. The septum of claim 1, wherein the membrane is frangible.

10. The septum of claim 1, wherein the first surface is substantially flat.

11. The septum of claim 3, wherein each of the ribs has a depth about one and a half times a distance to an adjacent one of the ribs.

12. The septum of claim 3, wherein each of the ribs has a depth about fifteen times a thickness of the membrane.

13. The septum of claim 1, wherein the ribs remain intact when a probe pierces the membrane.

14. The septum of claim 1, wherein the ribs extend along an entire length of the membrane.

15. The septum of claim 3, wherein the ribs are formed in a lid including a first lid surface facing an interior of a vessel when the lid is coupled to the vessel and a second lid surface opposite the first lid surface, the ribs formed in the second lid surface.

16. The apparatus of claim 15, wherein the plurality of ribs extend from the second lid surface in a direction opposite the first lid surface.

17. The septum of claim 3, wherein the probe is to engage one of the ribs or the membrane upon making contact with the septum.

18. The septum of claim 1, wherein the height of each rib is defined between the membrane and the first edge of the second surface.

19. The septum of claim 1, wherein a recess defined between two of the ribs extends from the first edge of the second surface to the second edge of the second surface.

20. The septum of claim 1, wherein the ribs form a circular pattern.

21. The septum of claim 1, wherein each of the ribs has a depth about one and a half times a distance to an adjacent one of the ribs.

22. The septum of claim 1, wherein each of the ribs has a depth about fifteen times a thickness of the membrane.

23. The septum of claim 3, wherein the height of each rib is defined between the membrane and the first edge of the second surface.

* * * * *